US006820697B1

(12) United States Patent
Churchill

(10) Patent No.: US 6,820,697 B1
(45) Date of Patent: Nov. 23, 2004

(54) DOWNHOLE BYPASS VALVE

(76) Inventor: Andrew Philip Churchill, 7 Ruby Place, Aberdeen, AB10 1QZ, Scotland (GB)

( * ) Notice: Subject to any disclaimer, the term of this patent is extended or adjusted under 35 U.S.C. 154(b) by 0 days.

(21) Appl. No.: 10/031,219

(22) PCT Filed: Jul. 14, 2000

(86) PCT No.: PCT/GB00/02712

§ 371 (c)(1),
(2), (4) Date: Jan. 15, 2002

(87) PCT Pub. No.: WO01/06086

PCT Pub. Date: Jan. 25, 2001

(30) Foreign Application Priority Data

Jul. 15, 1999 (GB) ..... 9916513

(51) Int. Cl.[7] ..... E21B 34/14; E21B 21/10

(52) U.S. Cl. ..... 166/374; 166/386; 166/318; 175/237; 175/317

(58) Field of Search ..... 166/318, 374, 166/386, 331, 319–324; 175/317, 234, 237

(56) References Cited

U.S. PATENT DOCUMENTS

| | | | | |
|---|---|---|---|---|
| 2,128,352 A | | 8/1938 | Creighton | 255/28 |
| 2,828,107 A | * | 3/1958 | Bobo | 175/69 |
| 3,645,331 A | | 2/1972 | Maurer et al. | 175/65 |
| 3,719,239 A | | 3/1973 | Richter, Jr. et al. | 175/50 |
| 3,799,278 A | * | 3/1974 | Oliver | 175/237 |
| 3,878,889 A | | 4/1975 | Seabourn | 166/0.5 |
| 3,993,974 A | | 11/1976 | Silverman et al. | 340/15.5 MC |
| 4,260,017 A | * | 4/1981 | Nelson et al. | 166/154 |
| 4,292,988 A | * | 10/1981 | Montgomery | 137/68.17 |
| 4,310,050 A | * | 1/1982 | Bourgoyne, Jr. | 166/318 |
| 4,406,335 A | * | 9/1983 | Koot | 175/317 |
| 4,518,048 A | | 5/1985 | Varley | 175/61 |
| 4,645,006 A | | 2/1987 | Tinsley | 166/374 |
| 4,889,199 A | | 12/1989 | Lee | 175/317 |
| 5,174,379 A | * | 12/1992 | Whiteley et al. | 166/278 |
| 5,499,687 A | | 3/1996 | Lee | 175/317 |
| 5,564,500 A | * | 10/1996 | Rogers et al. | 166/312 |
| 5,609,178 A | * | 3/1997 | Hennig et al. | 137/10 |
| 5,695,009 A | | 12/1997 | Hipp | 166/196 |
| 5,732,775 A | * | 3/1998 | Hudson et al. | 166/177.4 |
| 5,782,305 A | | 7/1998 | Hicks | 166/376 |
| 5,797,454 A | | 8/1998 | Hipp | 166/196 |
| 5,934,377 A | | 8/1999 | Savage | 166/281 |
| 5,941,309 A | | 8/1999 | Appleton | 166/317 |
| 5,990,051 A | | 11/1999 | Ischy et al. | 507/204 |
| 6,006,838 A | * | 12/1999 | Whiteley et al. | 166/306 |
| 6,173,795 B1 | * | 1/2001 | McGarian et al. | 175/231 |
| 6,189,618 B1 | * | 2/2001 | Beeman et al. | 166/312 |
| 6,253,861 B1 | * | 7/2001 | Carmichael et al. | 175/237 |
| 6,296,059 B1 | * | 10/2001 | Leeb et al. | 166/317 |
| 6,378,612 B1 | * | 4/2002 | Churchill | 166/319 |

FOREIGN PATENT DOCUMENTS

| | | |
|---|---|---|
| EP | 0732479 | 7/1996 |
| EP | 0860583 | 8/1998 |
| GB | 688727 | 3/1953 |
| GB | 2304763 | 3/1997 |
| GB | 2305681 | 3/1997 |
| WO | WO 91/11587 | 8/1991 |
| WO | WO9922114 | 5/1999 |
| WO | WO9947789 | 4/2002 |

* cited by examiner

*Primary Examiner*—David Bagnell
*Assistant Examiner*—Shane Bomar
(74) *Attorney, Agent, or Firm*—Gifford, Krass, Groh, Sprinkle, Anderson & Citkowski, P.C.

(57) ABSTRACT

A fluid flow actuated downhole tool is configurable in at least a first tool configuration and a second tool configuration. The tool comprises a tubular housing and an activating sleeve, the housing being adapted to catch the sleeve when the sleeve is dropped from surface and the engagement of the sleeve with the housing permitting actuation.of the tool between the first and second tool configurations. A flow restriction is provided for permitting fluid flow actuation of the tool when the activating sleeve has been caught in the body.

16 Claims, 6 Drawing Sheets

DOWNHOLE BYPASS VALVE

FIELD OF THE INVENTION

The present invention relates to a downhole tool which is actuatable between at least two tool configurations. In particular, but not exclusively, the present invention relates to a downhole tool comprising a bypass tool for location in a borehole of a well, wherein the bypass tool is actuatable between a closed configuration and an open configuration in response to the flow of fluid through the borehole.

BACKGROUND OF THE INVENTION

Bypass tools are typically disposed within a borehole of, for example, an oil well, for selectively allowing fluid communication between a bore defined by a tubular string disposed in the borehole, and an annulus defined between an outer wall of the tubing string and an inner wall of the borehole. Typical known assemblies are often complex, comprising many interconnected components, and often require, for example, multiple fluid pressure cycles of fluid in the borehole to actuate the bypass tool between two or more distinct tool configurations.

It is amongst the objects of the present invention to obviate or mitigate at least one of the foregoing disadvantages.

SUMMARY OF THE INVENTION

According to the present invention there is provided a fluid flow actuated downhole tool being configurable in at least a first tool configuration and a second tool configuration, the tool comprising:

a tubular housing;

an activating sleeve, the housing being adapted to catch the sleeve when dropped from surface and then permitting actuation of the tool between the first and second tool configurations; and flow restriction means for permitting fluid flow actuation of the tool when the activating sleeve has been caught in the body.

The invention also relates to a method of operating a fluid flow actuated tool, the method comprising:

running the tool into a borehole in a tubular string;

circulating fluid through the string and the tool;

passing an activating sleeve into the string;

catching the sleeve in the tool; and circulating fluid through the string, the sleeve and a flow restriction in the tool in order to actuate the tool.

Thus, prior to the sleeve being caught in the tool, the tool is "dormant", and may only be actuated after the sleeve is received in the tool.

As noted above the sleeve is simply dropped into the string and is allowed to fall through the string, or may in addition also be carried into the string by circulating fluid.

Unlike a ball or other flow occluding tool activating member, which will substantially occlude the string bore, the use of a tool activating sleeve allows fluid to continue to flow through the string and tool, and may permit access to the section of the bore below the tool. Also, the use of a sleeve allows fluid to be circulated while the sleeve is moving down through the string; unlike a ball or other flow-occluding device, the sleeve will not induce a large hydraulic shock on engaging the tool.

The sleeve may define a flow restriction, such as a nozzle, which flow restriction permits or facilitates fluid actuation of the tool. Alternatively, the restriction may be defined by another part of the tool, which part is fixed before the sleeve is caught in the tool. Two or more axially spaced flow restrictions may be provided, allowing creation of a greater fluid pressure force without a significant restriction in bore diameter.

The tool may be a bypass tool, preferably the tool being initially closed, and after the sleeve is caught in the tool the tool may be re-configured to permit flow between the tool bore and the surrounding annulus.

Preferably, following activation of the tool by the sleeve, the tool may be repeatedly actuated between the first and second configurations.

A further aspect of the invention relates to a method of operating a fluid flow actuated tool, the method comprising:

(a) running the tool into a borehole in or as a part of a tubular string;

(b) circulating fluid through the string and tool;

(c) passing an activating device into the tool;

(d) catching the device in the tool;

(e) circulating fluid through the string and the tool including the device, to actuate the tool; and (f) repeating step (e) at least once.

Preferably, the activating device is a sleeve, which may define a restriction or nozzle, incorporate a rupture disc, or contain an extrudable or soluble material.

The activation for the tool may be achieved by releasing a coupling to permit relative movement of parts of the tool, which coupling may be, for example, a shear coupling or a sprung coupling.

Another aspect of the invention relates to a method of actuating a downhole tool, the method comprising:

running a tool into a borehole in a tubular string;

circulating fluid through the string and tool;

locating an activating device in the string; and circulating fluid through the string and tool as the device travels down through. the string, as the device engages the tool, and following engagement of the device and the tool.

This method is particularly useful in drilling or circulating operations, as there is no requirement to stop fluid circulation as the device moves through the string and then engages the tool, such that drilling or circulation may continue with the device in the string with a fluid flowrate sufficient to entrain drill cutting and carry them to surface, or to allow continuation of some other fluid circulation-related activity. This contrasts with conventional methods, in which it is necessary to stop or at least substantially reduce circulation to prevent the occurrence of a hydraulic shock on the activating device, typically in the form of a steel ball, engaging the tool. Such a hydraulic shock would result in damage to the ball and tool, and possibly also to the string itself.

The activating device may be a sleeve, such that the device restricts fluid flow to a limited extent but does not occlude the string bore.

A still further aspect of the present invention provides a downhole tool for disposition in a borehole of a well, the tool being configurable in at least a first and a second tool configuration, the tool comprising:

a tubular housing for running into a borehole on a tubing string;

a tubular sleeve assembly for disposition within the tubular housing and axially movable therein and including fluid responsive means for actuating the tool between said first and second tool configurations; and means for maintaining said sleeve assembly in a selected one of said first and second tool configurations.

Thus the present invention allows a downhole tool to be disposed in a borehole, which tool may be actuated between two or more tool configurations by supplying fluid to the tool in the borehole and by varying the flow rate of the fluid through the tool.

Preferably, the downhole tool is a bypass tool. The bypass tool may be in a closed configuration in the first tool configuration and an open configuration in the second tool configuration. The tubular housing may form part of a liner, casing, or drill string or any other tubing string for disposition in the borehole.

The tubular housing of the bypass tool may comprise at least one bypass port extending through a wall of the housing. The at least one bypass port may extend radially through the wall of the housing. The sleeve assembly may be axially movable to selectively move to the open configuration, to allow fluid communication between the housing interior wall, and an annulus defined by an outer face of the housing wall and the borehole wall.

The fluid responsive means may include a flow restriction, such that flow of fluid induces a pressure differential, and therefore a fluid pressure force, across the restriction. Alternatively, said means may define a differential piston with, for example, one piston face experiencing internal housing pressure and another face experiencing annulus pressure, such that an increase in internal pressure will actuate the tool.

The tubular sleeve assembly may comprise a control sleeve and a flow restriction within the control sleeve for restricting the flow of fluid through the control sleeve.

Preferably, the restriction is defined by an insert which may be dropped or lowered from the surface into the tubing string and may travel through the string and engage the control sleeve. Fluid flow through the flow restriction creates a force acting axially across the flow restriction, and thus on the control sleeve, urging the sleeve assembly to move axially. Alternatively, the flow restriction may be integral with the control sleeve. The flow restriction may comprise an annular, radially inwardly extending ring defining a nozzle.

The maintaining means may comprise a releasable connection, such as one or more sprung dogs, keys or a shear connection, such as one or more shear pins, for engaging the control sleeve and maintaining it in a selected one of said first and second tool configurations.

The bypass tool may further comprise a flow restriction-engaging insert, such as a nozzle, dart, sleeve or ball, for engaging the flow restriction, although as noted above in other embodiments the insert may itself provide the flow restriction. Thus, in response to pressurisation of the fluid in the tubing string above the insert, a pressure force acting across the insert may be caused to urge the tubular sleeve assembly axially downwardly to release the connection, and in addition or alternatively to actuate the tool. The flow restriction engaging insert may be injected into the tubing string at the surface and may travel through the string bore to engage the flow restriction. When the insert is a ball, preferably the ball is deformable to allow the ball to be forced through the flow restriction in response to an increase in the pressure of the fluid in the tubing string above the ball.

In an alternative arrangement, the tubular insert may be adapted to release the connection on engaging the control sleeve.

Preferably, the downhole tool further comprises indexing means for selectively allowing actuation of the tool between said first and second tool configurations. The indexing means may comprise a cam arrangement such as a groove, slot or other profile extending around an outer circumference of the tubular sleeve assembly, and a cam follower such as a pin extending radially inwardly from an inner surface of the housing for engaging the groove. of course, in alternative arrangements the groove or the like may be defined by the housing, and the pin or the like mounted on the sleeve assembly. In still further arrangements, the indexing means may be provided between different parts of the sleeve assembly. The pin and groove may co-operate to rotate the tubular sleeve assembly, or at least a part of the assembly, when it is moved axially. Conveniently, the groove defines first and second axial pin rest positions. Preferably, the groove defines a plurality of first and second axial pin rest positions. The first axial pin rest position may correspond to a valve open configuration and the second axial pin rest position may correspond to a valve closed configuration. The groove may further define a plurality of third axial pin rest positions for allowing actuation of the tool to an intermediate configuration between said first and second tool configurations, and which intermediate position may provide a further tool function, or may correspond to the function provided by one of the first or second tool configurations. The third axial pin rest positions may be provided between second axial pin rest positions. Thus the groove and pin may allow the tool to be disposed in the intermediate configuration alternatively when the pressure in the borehole is increased.

The maintaining means may further or alternatively comprise a spring for applying a force upon the sleeve assembly. The spring may be a fluid spring or a compression or tension spring. Preferably, the spring is disposed in an annular cavity between the housing and the sleeve assembly, to impart an upward force upon the sleeve assembly, to maintain it in a closed configuration.

BRIEF DESCRIPTION OF THE DRAWINGS

Embodiments of the invention will now be described, by way of example only, with reference to the accompanying drawings, in which.

DETAILED DESCRIPTION OF THE PREFERRED EMBODIMENTS

Figure 1A:
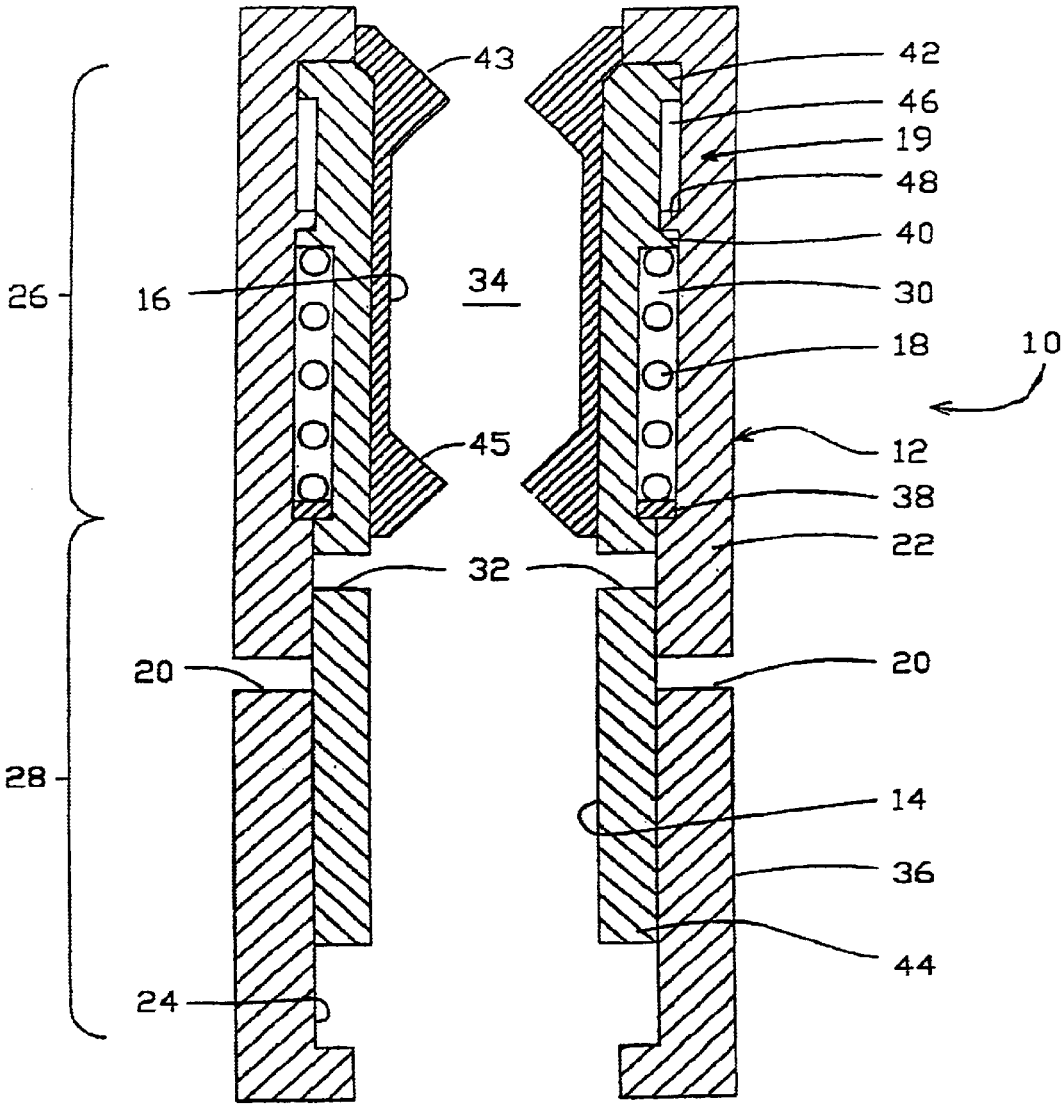
FIG. 1A is a longitudinal cross-sectional view of a downhole tool in accordance with an embodiment of the present invention.

Referring firstly to FIG. 1, there is shown a longitudinal cross-sectional view of a downhole tool in accordance with an embodiment of the present invention, the downhole tool indicated generally by reference numeral 10. The downhole tool 10 forms part of a drill string (not shown) run into a borehole (not shown) of an oil well, and is coupled at its upper and lower ends to sequential sections of drill string tubing via threaded joints, in a fashion known in the art.

The downhole tool 10 shown in FIG. 1A is a bypass tool comprising a tubular outer housing 12, a tubular bypass sleeve 14, a tubular flow restriction insert 16, a bypass sleeve spring 18 and a pin and groove assembly indicated generally by reference numeral 19.

Those of skill in the art will understand that the tool 10 will be provided with a variety of appropriate seals, however in the interest of brevity the individual seals will not be identified and described.

The tubular outer housing 12 includes flow ports 20 extending radially through a wall 22 of the housing 12, and spaced circumferentially around the housing 12. For clarity, only two such ports 20 are shown in FIG. 1A, however it will be appreciated that any suitable number of such flow ports 20 may be provided in the housing 12. The housing 12 has an inner face 24 and the internal diameter of the housing 12 defined by the inner face 24 varies along the length of the housing 12 from top to bottom. In particular, an upper portion 26 of the housing 12 is of a first general internal diameter, whilst a lower portion 28 of the housing 12 is of a smaller, second general internal diameter. This enables the housing 12, in conjunction with the tubular bypass sleeve 14, to define an annular cavity 30 in which the bypass sleeve spring 18 is located, as will be described in more detail below.

The tubular bypass sleeve 14 includes flow ports 32, and is axially movable within the housing 12, to enable the flow ports 20 of the housing 12 and the flow ports 32 of the sleeve 14 to be aligned. This allows communication between an internal tool bore 34 and an annulus defined between an outer face 36 of the housing 12 and the borehole wall.

The bypass sleeve spring 18 is a compression spring and is disposed in the cavity 30 between a washer 38 and a radially outwardly extending shoulder 40 of the bypass sleeve 14. In the position shown in FIG. 1A, the bypass sleeve spring 18 maintains the bypass sleeve 14 in a closed configuration wherein an upper end 42 of the bypass sleeve 14 is disposed adjacent to the upper end of the housing 12.

When it is desired to move the bypass sleeve 14 axially downwardly against the force of the bypass sleeve spring 18, to align the flow ports 20 and 32, the tubular flow restriction insert 16 is inserted into the drill string at the surface and carried down the internal string bore 34 until it engages the bypass sleeve 14 as shown in FIG. 1A. The flow restriction insert 16 includes annular, radially inwardly extending shoulders 43 and 45, which define first and second restrictions respectively. These restrictions to the flow of fluid through the internal bore 34 are such that, when fluid flows through the flow restriction insert 16, a pressure differential is created across each restriction and a downward axial force is imparted upon the flow restriction insert 16 by the flowing fluid. Until the insert 16 is located in the sleeve 14, the tool 10 is effectively dormant, as changes in fluid flow rate or pressure in the bore 34 will have no effect on the sleeve position.

The flow rate of the fluid through the string and tool is increased until the force upon the flow restriction insert 16 becomes sufficiently large to overcome the force imparted upon the bypass sleeve 14 by the bypass sleeve spring 18. The flow restriction insert 16 and the bypass sleeve 14 then move axially downwardly, compressing the spring 18 until the bypass sleeve 14 reaches the end of its travel, wherein a lower end 44 is disposed adjacent to the lower end of the housing 12. The flow ports 20 and 32 are then aligned, allowing fluid communication between the internal bore 34 and the annulus bore. This may allow operations such as a "clean-up" operation to be carried out, wherein drill cuttings or the like lying in sections of the borehole may be entrained with and carried back to the surface by the fluid flowing through the aligned bypass ports 32 and 20.

When it is desired to move the bypass sleeve 14 back to the closed configuration shown in FIG. 1A, the flow rate of the fluid flowing through the internal bore 34 is reduced, until the fluid pressure force applied by the fluid upon the bypass sleeve 14 and the flow restriction insert 16 drops below the force imparted upon the bypass sleeve 14 by the spring 18. The bypass sleeve 14 is then moved axially upwardly by the spring 18 acting against the shoulder 40 of the bypass sleeve 14.

Figure 1B:
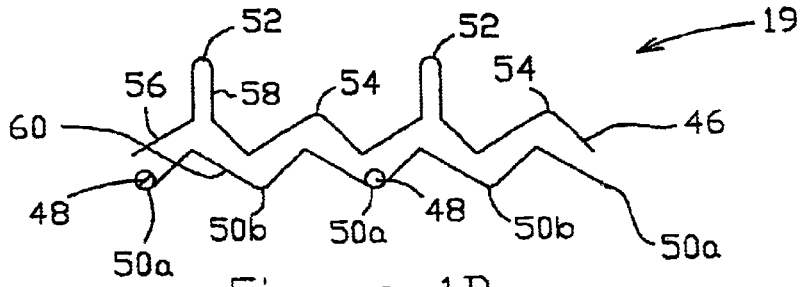
FIG. 1B is a schematic illustration of a pin and groove arrangement forming part of the downhole tool of FIG. 1A.

Referring now to FIG. 1B, there is shown a schematic illustration of the pin and groove arrangement 19 shown in FIG. 1A. The arrangement 19 includes an annular circumferential extending groove 46 and a pin 48, though for clarity the illustrated portion of the groove 46 is shown as a planar groove. The groove 46 is notched or corrugated and defines a number of first pin rest positions 50*a* and 50*b*, a number of second pin rest positions 52, and a number of third pin rest positions 54. The second and third pin rest positions 52 and 54 are spaced alternately around the circumference of the bypass sleeve 14. The pin 48 is shown in FIG. 1B in one of the first pin rest positions 50*a* where the bypass sleeve 14 is in the closed configuration of FIG. 1A.

When the flow restriction insert 16 has been located in the bypass sleeve 14, and the flow rate of fluid through the internal bore 34 has been increased to counteract the force of the bypass sleeve spring 18, the bypass sleeve 14 moves axially downwardly until the pin 48 engages the sloping face 56 of the groove 46, which rotates the bypass sleeve 14. The pin 48 then becomes engaged in a slot 58 and comes to rest in a second pin rest position 52, where the bypass sleeve 14 is in the open configuration with the flow ports 20 and 32 aligned. When the flow rate of the fluid is reduced, the bypass sleeve spring 18 carries the bypass sleeve 14 axially upwardly, and the pin 48 moves over the surface of a sloping face 60 of the groove 46, rotating the sleeve 14, to one of the first pin rest positions 50*b*.

When the flow rate is again increased, the bypass sleeve 14 again moves axially downwardly. However, movement of the sleeve 14 is stayed when the pin 48 comes to rest in the third pin rest position 54. Retention of the pin 48 in the third pin rest position 54 prevents the flow ports 20 and 32 from becoming aligned. This may be useful when, for example, it is desired to drill with drilling fluid flowing of an elevated rate but without opening the tool 10. When the fluid flow rate is next reduced, the pin 48 comes to rest in a first pin rest position 50*a*, whereupon subsequent increase of the fluid flow rate allows the bypass sleeve 14 to move fully axially downwardly, with the pin 48 engaged in the second pin rest position 52. Thus alternate opening of the bypass sleeve 14 may be achieved.

Figure 2:
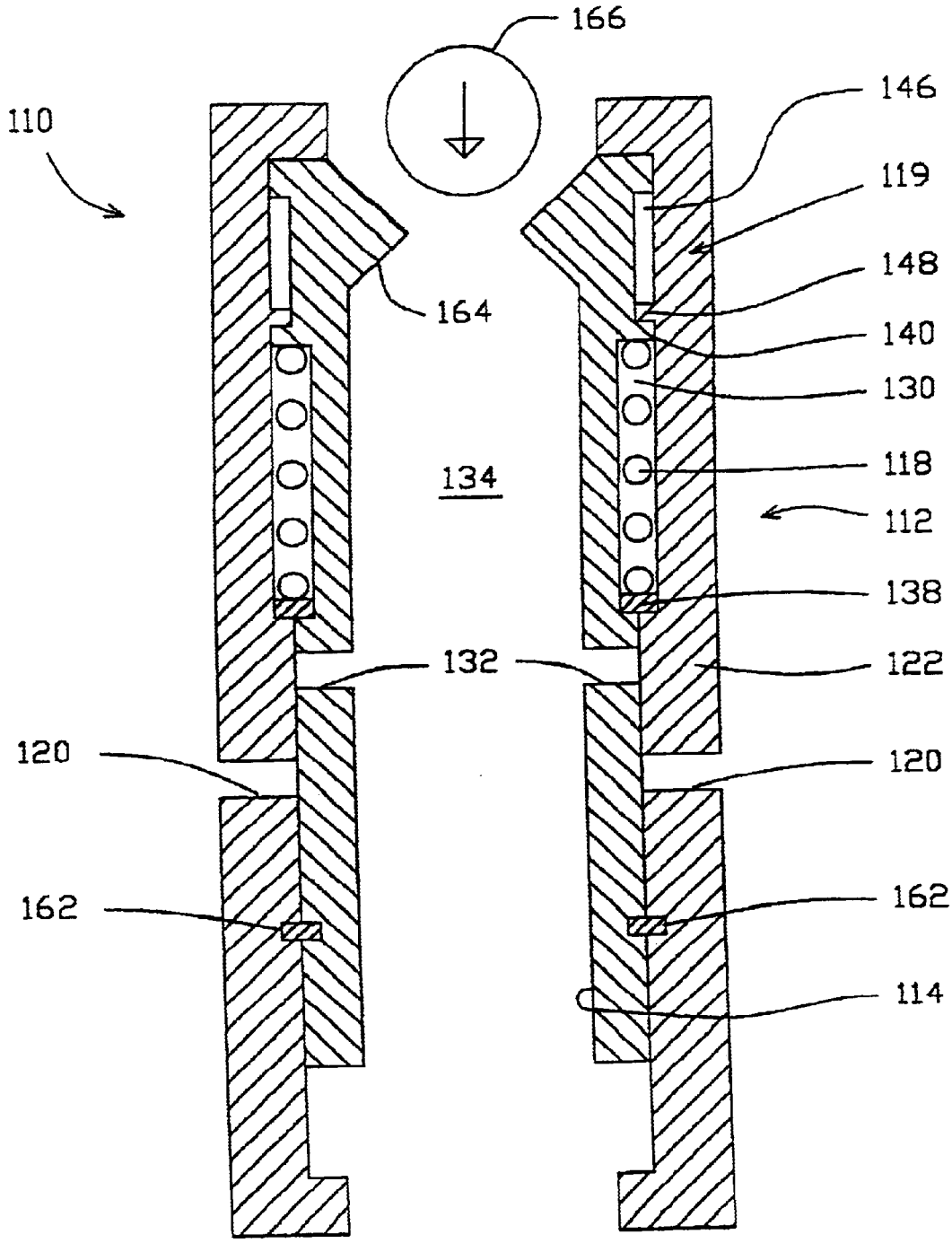
FIG. 2 is a longitudinal cross-sectional view of a downhole tool in accordance with an alternative embodiment of the present invention.

Referring now to FIG. 2, there is shown a longitudinal cross-sectional view of a downhole tool in accordance with an alternative embodiment of the present invention, indicated generally by reference numeral 110. For ease of reference, like components with the downhole tool 10 of FIG. 1A share the same reference numerals incremented by 100. The downhole tool 110 comprises a tubular outer housing 112, a tubular bypass sleeve 114, a bypass sleeve spring 118 and a pin and groove arrangement 119. Flow ports 120 extend through a wall 122 of the housing 112, and the bypass sleeve 114 includes flow ports 132 which may be aligned with the flow ports 120 of the housing 112, when the bypass sleeve 114 is moved axially downwardly, in a similar fashion to the bypass sleeve 14 of the downhole tool 10 of FIG. 1A.

The bypass sleeve spring 118 is disposed in an annular cavity 130 between a washer 138 and a shoulder 140 of the bypass sleeve 114. However, the housing 112 includes shear pins 162 disposed in the wall 122, which extend radially inwardly to engage the bypass sleeve 114. These shear pins 162 initially maintain the bypass sleeve 114 in a closed configuration as shown in FIG. 2. Furthermore, the bypass sleeve 114 includes an annular, radially inwardly extending shoulder 164 which defines a flow restriction.

When it is desired to move the bypass sleeve 114 to the open configuration, where the flow ports 120 and 132 are aligned, a deformable ball 166 is inserted into the string bore and travels down to the tool 110 through the string bore 134. The ball 166 is carried in a fluid such as drilling mud through the internal bore 134, and engages in the shoulder 164 of the bypass sleeve 114. This effectively blocks the internal bore 134. When the pressure of the fluid in the internal bore 134 above the tool 110 is increased, which may occur instantaneously on the ball 166 engaging the restriction 164, this creates a considerable pressure force acting axially downwardly upon the ball 166 and thus upon the bypass sleeve 114, which compresses the spring 118 and shears the pins 162. This moves the bypass sleeve 114 to the open configuration.

However, the internal bore 132 remains blocked by the ball 166. A further increase of the pressure of the fluid above the ball 166, or indeed a continuation of the hydraulic shock which created the initial force to shear the pins 162, causes the ball 166 to deform, elastically or plastically, and to pass through the restriction created by the shoulder 164 of the bypass sleeve 114, allowing fluid to flow through the bypass tool 110, through the flow ports 132 and 120, and into the annulus bore. A ball catcher may be provided (not shown) disposed in the part of the drill string tubing below the tool 110, to catch the ball 166 when it has passed through the bypass sleeve 114, or alternatively the ball may disintegrate or otherwise degrade.

The pin and groove arrangement 119 includes a groove 146 and a pin 148 and functions in a similar manner to the pin and groove arrangement 19 shown in FIG. 1B and described above. This therefore allows subsequent opening and closing of the bypass sleeve 114 in response to variations in the fluid flow rate acting on the flow restriction 164.

Figure 3:
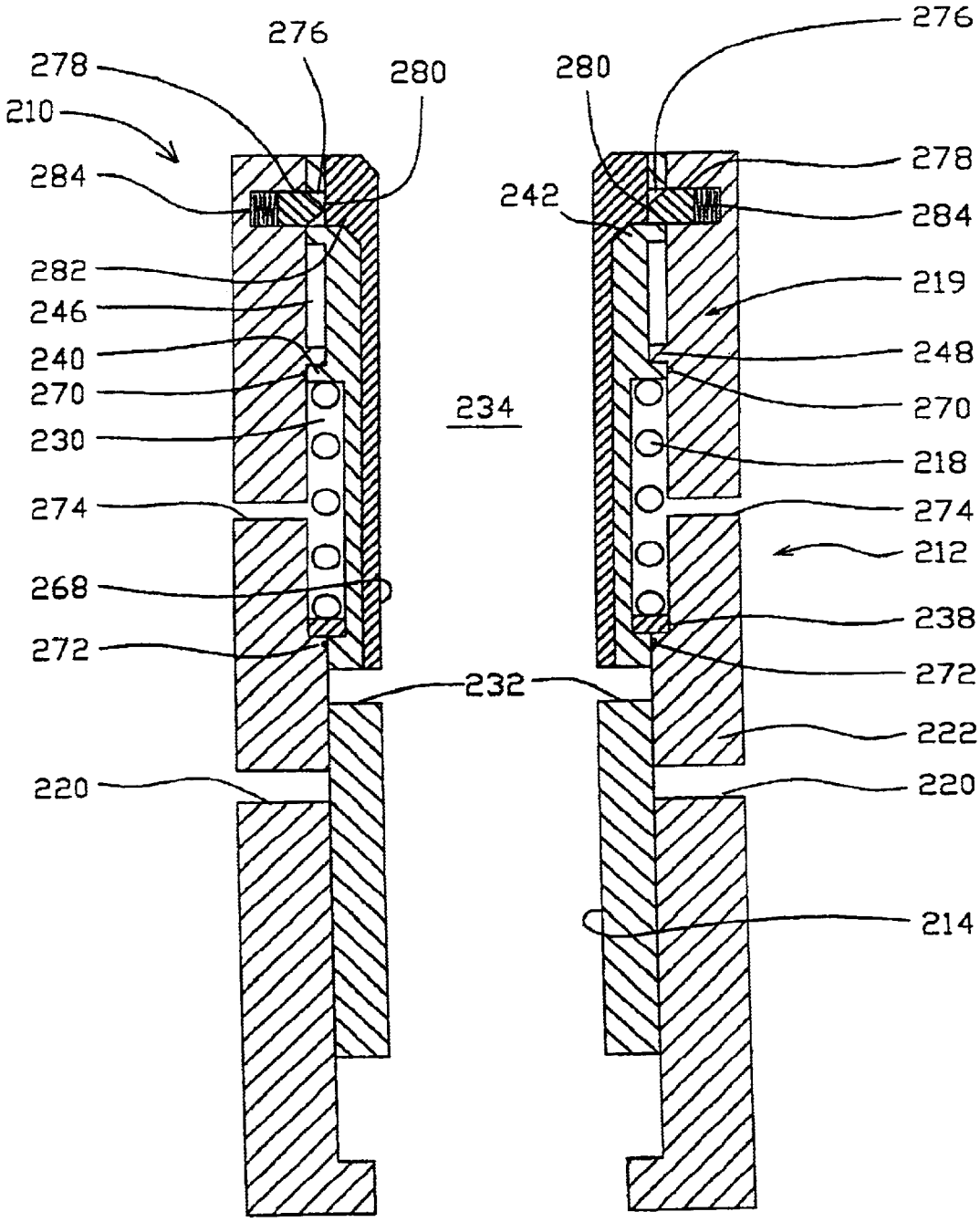
FIG. 3 is a longitudinal cross-sectional view of a downhole tool in accordance with a further embodiment of the present invention.

Referring now to FIG. 3, there is shown a downhole tool in accordance with a further embodiment of the present invention, indicated generally by reference numeral 210. For clarity, like components of the tool 210 with the tool 10 of FIG. 1A share the same reference numerals incremented by 200.

The downhole tool 210 comprises a tubular outer housing 212, a tubular bypass sleeve 214, a bypass sleeve spring 218, a pin and groove arrangement 219 and a tubular release sleeve 268. The housing 212 includes flow ports 220 disposed in a wall 222 of the housing 212 and extending radially therethrough.

The tubular bypass sleeve 214 includes flow ports 232 and is mounted in the housing 212 to define an annular cavity 230, in which the spring 218 is disposed, between a washer 238 and a shoulder 240 of the housing 212. Elastomeric O-ring type seals 270 and 272 respectively are provided in the wall 222 of the housing 212, to seal the annular cavity 230 and isolate it from fluid in the internal tool bore 234. Also, bleed holes 274 extend through the wall 222 of the housing 212, to fluidly couple the annular cavity 230 with the annulus of the borehole in which the tool 210 is disposed. Thus fluid in the annular cavity 230 experiences the same pressure as fluid in the annulus.

The bypass sleeve 214 includes openings 276 at its upper end 242, for engaging spring-loaded locking dogs 278, to retain the sleeve 214 in the closed configuration shown in FIG. 3, whereby the flow ports 220 and 232 are misaligned. This prevents fluid communication between the internal bore 234 and the annulus bore. As shown in FIG. 3, the leading end 280 of each locking dog 278 is chamfered. This allows the release sleeve 268 to be run into the borehole and located within the bypass sleeve 214 as shown in FIG. 3, wherein a radially outwardly extending shoulder 282 of the sleeve 268 engages the leading end 280 of each locking dog 278. This compresses a spring 284 of each locking dog 278, forcing each locking dog 278 radially outwardly such that only the chamfered leading end 280 protrudes into the apertures 276.

To actuate the tool 210 to an open configuration, the pressure of fluid flowing through the internal bore 234 is increased such that the differential pressure between the fluid in the internal bore 234 and the fluid in the annulus bore increases. As the seal 270 defines a larger diameter than the seal 272, a net axially downward force is imparted upon the bypass sleeve 214 due to this differential pressure. This causes the actuating sleeve 268 and the bypass sleeve 214 to move axially downwardly. The locking dogs 278 are disengaged from the engaging apertures 276 of the bypass sleeve 214 by the bypass sleeve 214 passing over the chamfered leading end 280 of each locking dog 278. This allows the flow ports 220 and 232 to be aligned, allowing fluid communication between the internal tool bore 234 and the annulus. When the pressure of the fluid in the internal bore 234 is reduced sufficiently such that the net force upon the bypass sleeve 214 falls below the restoring force of the spring 218, the spring 218 returns the bypass sleeve 214 to the closed configuration shown in FIG. 3, by acting against the shoulder 240 of the housing 212.

The pin and groove arrangement 219 comprises a groove 246 and a pin 248 similar to the groove 46 and pin 48 of FIG. 1B and the tool 10 of FIG. 1A. When the bypass sleeve 214 returns to the closed configuration of FIG. 3, the locking dogs 278 again engage the engaging holes 276 of the bypass sleeve 214 to retain the sleeve in the closed configuration, until the pressure of the fluid in the internal bore 234 is increased sufficiently to counteract the spring force 218 and force the locking dogs 278 radially outwardly.

Figures 4A, 4B:
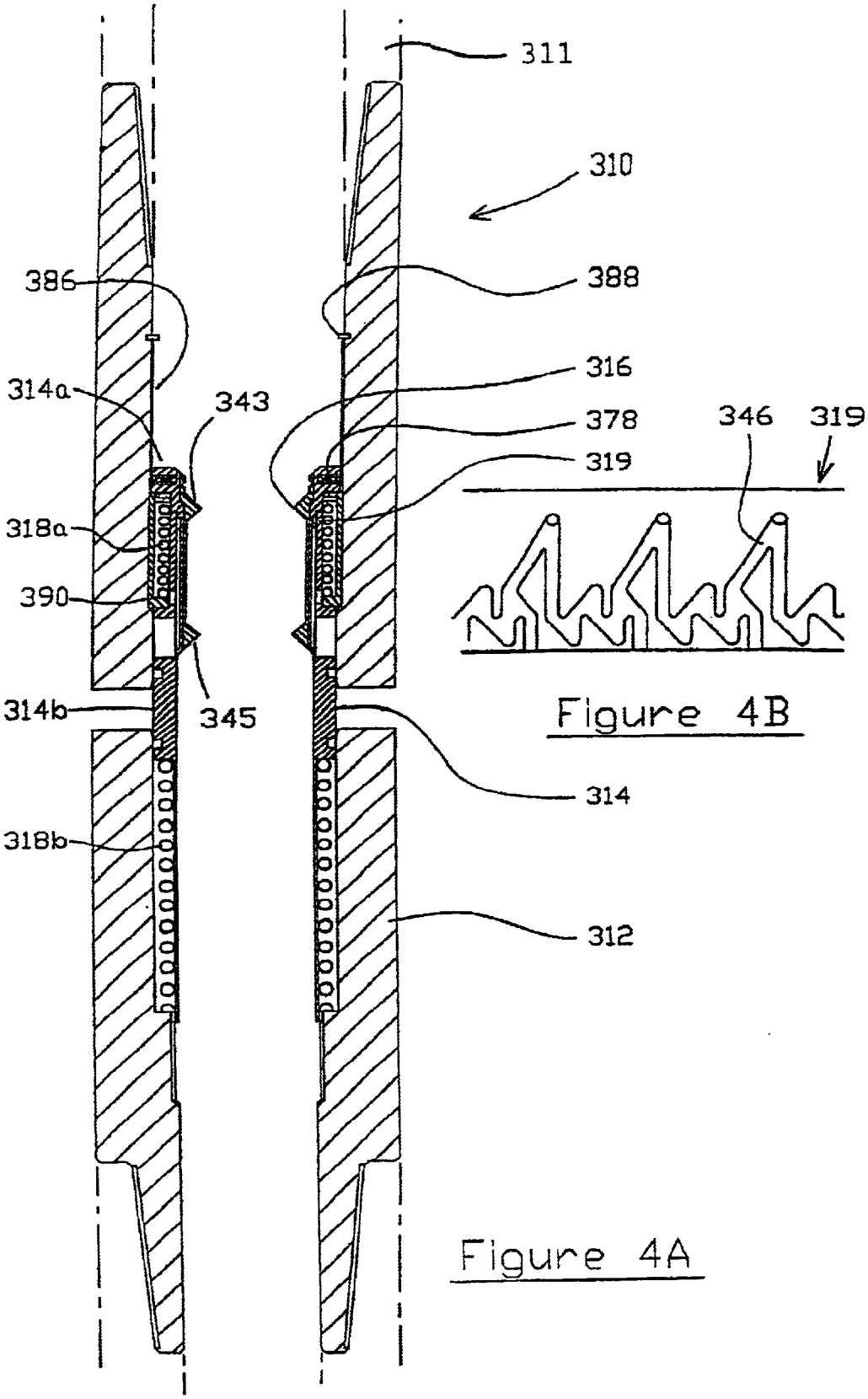
FIG. 4A is a longitudinal sectional view of a downhole tool in accordance with another embodiment of the present invention.
FIG. 4B is a schematic illustration of a pin and groove arrangement forming part of the tool of FIG. 4A.
Figure 5:
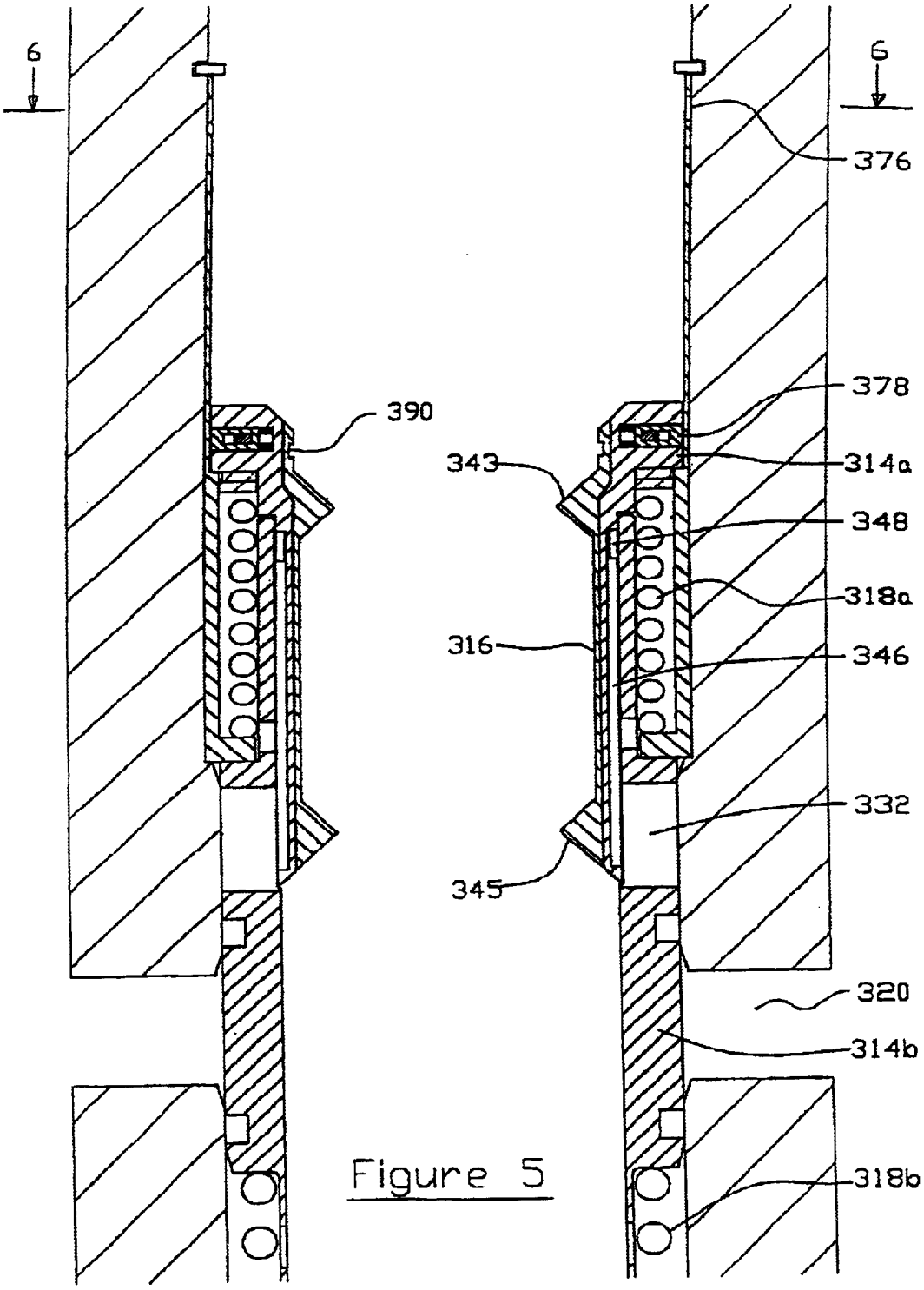
FIG. 5 is an enlarged view of part of the tool of FIG. 4A.

Reference is now made to FIG. 4A of the drawings, which illustrates a bypass tool 310 in accordance with another embodiment of the invention. The tool 310 is similar in some respects to the tool 210 of FIG. 3, and therefore common features of the tools 210, 310 will not be described again in any detail.

The tool 310 comprises a housing 312, a two-part bypass sleeve 314, a flow restriction sleeve 316, a pair of sleeve springs 318*a*, 318*b*, and a sleeve movement controlling pin and groove assembly 319.

Unlike the previous illustrated tools, the tool 310 is illustrated in a configuration in which the tool 310 is experiencing elevated fluid flow therethrough, but the sleeve movement controlling assembly 319 has not transmitted the corresponding axial movement of the restriction sleeve 316 and the associated part of the bypass sleeve 314*a* to the other part of the sleeve 314*b* defining the flow ports 312, as will be described below.

Figure 6:
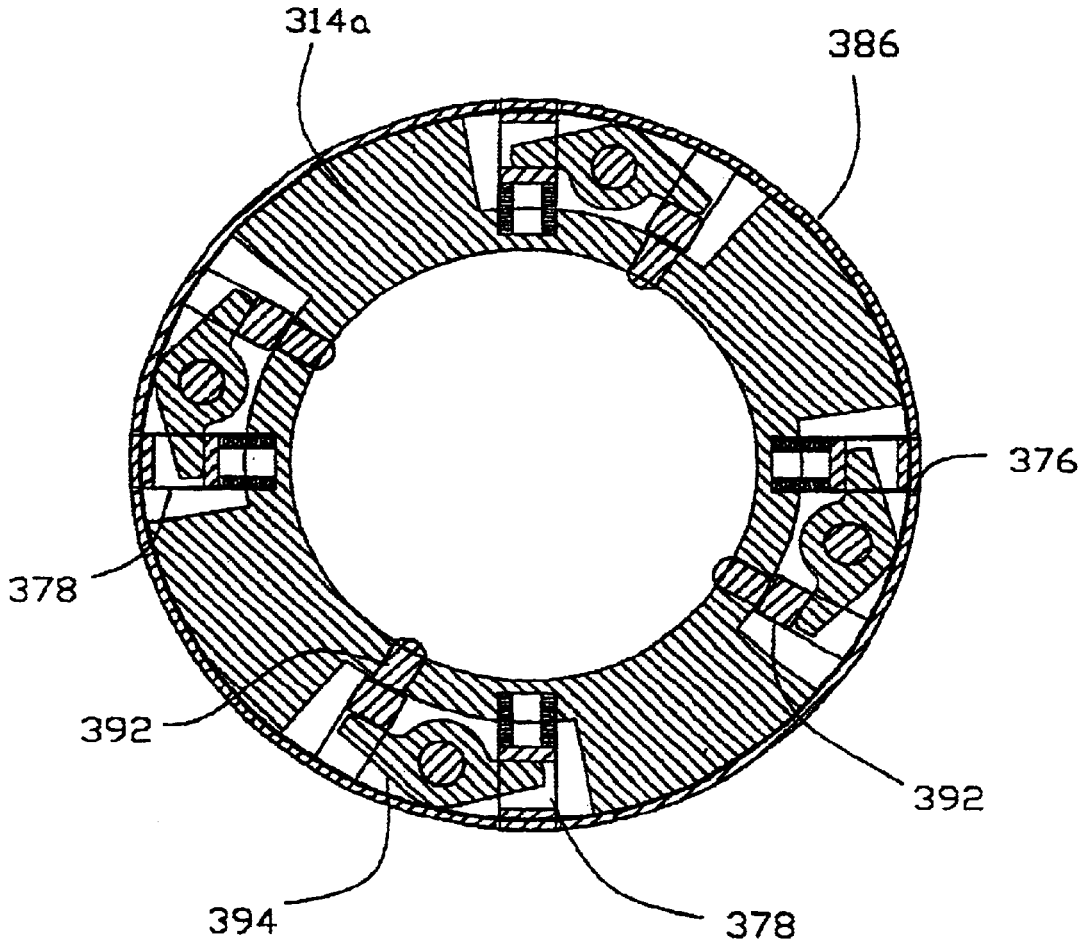
FIG. 6 is a further enlarged sectional view on line 6—6 of FIG. 5.

The tool 310 is initially run in without the restriction sleeve 316. As noted above, the bypass sleeve 314 is in two parts 314*a,* 314*b,* coupled by the pin and groove arrangement 319, the form of which is illustrated in FIG. 4B of the drawings. The upper sleeve part 314*a,* which defines the groove 346, is initially locked to the housing 312 by an arrangement of sprung dogs 378, as illustrated in FIG. 6 of the drawings. The dogs 378 are mounted in the sleeve 314*a* and are biassed radially outwardly to engage recesses 376 in a sleeve 386 located on the housing 312 between a circlip 388 and a housing shoulder 390. Four circumferentially spaced dogs are provided, and are adapted to be retracted by the radial movements of respective release pins 392 coupled to the dogs 378 by rocker arms 394. In this position, the springs 318*a,* 318*b* which act on the respective sleeve parts 314*a,* 314*b,* to urge the sleeve parts towards the closed position, are fully extended.

In this initial configuration, the tool 310 is effectively dormant, and variations in fluid flow or pressure differentials will have no effect on the tool configuration. This allows the tool 310 to be effectively "ignored", until the tool 310 is required. This is useful as it allows, for example, drilling operators to vary drilling mud flowrate and pressure, and to switch mud pumps on and off without any concern for the tool configuration.

When it is desired to utilise the tool 310, the sleeve 316 is placed in the drill string 311, and will be carried to the tool 310 in the drilling fluid. The presence of restrictions 343, 345 in the sleeve 316 facilitates the sleeve 316 being carried by the flow, however the relatively minor flow restriction created by the free-falling sleeve 316 allows the drilling operators to maintain drilling fluid flow at the normal drilling rate, such that drilling is not interrupted by the passage of the sleeve 316 through the string 311 to the tool 310.

On reaching the tool location, the sleeve 316 engages the upper part of the bypass sleeve 314a, and in doing so pushes the release pins 392 outwardly to disengage the sleeve 314*a* from the housing 312. The engagement of the restriction sleeve 316 with the bypass sleeve 314a creates a restriction in the fluid pathway through the string, but not to the extent that a significant hydraulic shock is induced.

Flow through the restrictions 343, 345 creates a differential pressure force across the sleeve 316 and, if the force is sufficient, the upper by-pass sleeve 314*a* will move downwards, compressing the spring 318*a*. Further, depending on the position of the pin 348 in the groove 346, the pressure force will be transferred to the lower bypass sleeve 314*b*. If sufficient force is created, the sleeve 314*b* may be moved downwards, compressing the spring 318*b,* and aligning the ports 332,320.

By varying the drilling fluid flow rate through the tool 310, it is thus possible to cycle the position of the sleeve parts 314*a,* 314*b,* to selectively open or close the ports 332, 320.

If there comes a point in the drilling operation where the tool 310 is no longer required, the sleeve 316 may be retrieved by wireline or the like and using a fishing tool adapted to engage a profile 390 in the upper end of the sleeve 316.

Various modifications may be made to the foregoing embodiments within the scope of the present invention. For example, the downhole tool may be any tool capable of being actuated between first and second tool configurations..

What is claimed is:

1. A method of providing fluid bypass in a downhole string, the method comprising the steps:

providing a bypass tool having a body defining an axial through bore and including a wall defining a fluid port, and an operating sleeve mounted to the body and normally positioned to close the port;

running the tool into a bore on a string;

dropping an activating device through the string to land on the operating sleeve; and passing fluid through the string, body and operating sleeve, and also a flow restriction operatively associated with the operating sleeve and located upstream of the port, at selected flow rates to create selected fluid flow-related forces on the operating sleeve to move the sleeve to open the port.

2. The method of claim 1, further comprising maintaining fluid flow through the string, body and operating sleeve at a normal operational level at least as the activating device passes through the string and lands on the operating sleeve.

3. The method of claim 2, further comprising maintaining fluid flow through the string, body and operating sleeve at a normal operational level following landing of the activating device on the operating sleeve, and at least initially retaining the sleeve in position to close the fluid port.

4. A downhole tool having first and second configurations and adapted to be run into a bore in the first configuration, the tool comprising:

a body adapted to be mounted on a tubular drill string and having an axial through bore for permitting passage of fluid therethrough while the tool remains in the first configuration;

an activating sleeve configured to travel through the string to land on the body and activate the tool; and flow responsive means for cycling the activated tool between the first and second configurations in response to variations in fluid flowrate through the tool and sleeve between a first fluid flow rate of a normal operational level for drilling operations and a higher second fluid flow rate.

5. The tool of claim 4, further comprising indexing means for controlling cycling of the tool between the first and second configurations and permitting the tool to be in either one of the first and second configurations while the fluid flowrate is maintained at a normal, operational level.

6. The tool of claim 4, wherein the activating sleeve is adapted to release a coupling on landing on the body to activate the tool into the second configuration.

7. The tool of claim 4, further including means for biasing the tool towards the first configuration.

8. The tool of claim 4, wherein the flow responsive means includes a differential piston.

9. The tool of claim 4, wherein the flow responsive means includes a flow restriction.

10. The tool of claim 9, wherein the flow restriction is defined by the activating sleeve.

11. The tool of claim 9, wherein the flow responsive means includes at least two axially spaced flow restrictions.

12. The tool of claim 4, wherein the tool is a bypass tool, the body defining a bypass port and wherein the bypass port is closed in the first configuration and open in the second configuration.

13. A method of operating a downhole tool, the method comprising:

running a tool into a bore on a string with the tool in a first configuration;

passing fluid through the string and an axial through bore defined by the tool with the tool remaining in the first configuration;

passing an activating sleeve from the surface through the sting to land on and activate the tool;

cycling the activated tool between first and second configurations in response to variations in fluid flowrate through the tool; and further comprising maintaining fluid flow through the string and body at a normal operational level at least as the activating sleeve passes through the string and lands on the tool.

14. The method of claim 13, further comprising maintaining fluid flow through the string and body at normal operational level following landing of the activating sleeve on the tool, and at least initially retaining the tool in the first configuration following landing of the activating sleeve on the tool.

15. The method of claim 13, further comprising maintaining the tool in the first configuration while the fluid flowrate is maintained at a normal, operational level, and subsequently maintaining the tool in the second configuration while the fluid flowrate is maintained at a normal, operational level.

16. A method of operating a downhole tool, the method comprising:

running a tool into a bore on a sting with the tool in a first configuration;

passing fluid through the string and an axial through bore defined by the tool with the tool remaining in the first configuration;

passing an activating sleeve from surface through the string to land on and activate the tool;

cycling the activated tool between first and second configurations in response to variations in fluid flowrate through the tool; and further comprising maintaining the tool in the first configuration while the fluid flowrate is maintained at a normal, operational level, and subsequently maintaining the tool in the second configuration while the fluid flowrate is maintained at a normal operational level.

* * * * *